US007155136B2

(12) United States Patent
Nihonyanagi et al.

(10) Patent No.: US 7,155,136 B2
(45) **Date of Patent: *Dec. 26, 2006**

(54) IMAGE HEATING APPARATUS HAVING HEATER FOR EXTERNALLY HEATING FIXING ROLLER

(75) Inventors: Koji Nihonyanagi, Susono (JP); Toshio Miyamoto, Numazu (JP); Masahiko Suzumi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/046,872

(22) Filed: Feb. 1, 2005

(65) Prior Publication Data

US 2005/0169656 A1 Aug. 4, 2005

(30) Foreign Application Priority Data

Feb. 3, 2004 (JP) ..... 2004-026239
Jan. 19, 2005 (JP) ..... 2005-011711

(51) Int. Cl.
*G03G 15/20* (2006.01)

(52) U.S. Cl. ..... 399/69; 399/327

(58) Field of Classification Search ..... 399/327
See application file for complete search history.

(56) References Cited

U.S. PATENT DOCUMENTS 5,682,576 A 10/1997 Sakai et al. ..... 399/69
6,005,594 A 12/1999 Nanataki et al. ..... 347/156
6,075,228 A 6/2000 Goto et al. ..... 219/216
6,085,058 A 7/2000 Goto et al. ..... 399/313
6,175,699 B1 1/2001 Kato et al. ..... 399/69
6,347,211 B1 2/2002 Nanataki et al. ..... 399/328
6,493,521 B1 12/2002 Miyamoto et al. ..... 399/44
6,516,166 B1 * 2/2003 Sakakibara et al. ..... 399/67
6,701,102 B1 3/2004 Hasegawa et al. ..... 399/69
6,713,725 B1 3/2004 Izawa et al. ..... 219/216
6,748,192 B1 6/2004 Izawa et al. ..... 399/329
6,763,205 B1 7/2004 Izawa et al. ..... 399/69
6,787,737 B1 9/2004 Uekawa et al. ..... 129/216
6,794,611 B1 9/2004 Kataoka et al. ..... 219/216
6,862,416 B1 3/2005 Hashiguchi et al. ..... 399/69
6,944,420 B1 9/2005 Kanamori et al. ..... 399/329
6,952,538 B1 10/2005 Hashiguchi et al. ..... 399/45

(Continued)

FOREIGN PATENT DOCUMENTS

JP 8-129313 5/1996

(Continued)

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

The image heating apparatus for heating a toner image formed on a recording material, comprising, a rotatable member; heating device for heating an outer peripheral surface of the rotatable member, the heating device including a heater for forming a heating nip portion in cooperation with the rotatable member; back-up device for forming a conveying nip portion in cooperation with the rotatable member, the conveying nip portion conveying the recording material; and control device for controlling a temperature of the heater and a rotation of the rotatable member, wherein the apparatus has a cleaning mode to remove toner from the heating device, and the control device rotates or reversely rotates the rotatable member in a condition that the heater dissipates heat in the cleaning mode. By the virtue of the present invention, it prevents stain caused by the off-set of toner the recording material in an image heating apparatus.

5 Claims, 12 Drawing Sheets

U.S. PATENT DOCUMENTS

| | | | | |
|---|---|---|---|---|
| 2003/0118363 | A1* | 6/2003 | Izawa et al. | 399/69 |
| 2004/0042827 | A1 | 3/2004 | Izawa et al. | 399/328 |
| 2004/0091279 | A1 | 5/2004 | Izawa et al. | 399/67 |
| 2004/0114975 | A1 | 6/2004 | Sano et al. | 399/328 |
| 2004/0202497 | A1 | 10/2004 | Hotta et al. | 399/328 |
| 2005/0191070 | A1 | 9/2005 | Izawa et al. | 399/44 |
| 2005/0191075 | A1 | 9/2005 | Kimizuka et al. | 399/69 |
| 2005/0201788 | A1 | 9/2005 | Kubochi et al. | 399/381 |
| 2005/0207770 | A1* | 9/2005 | Nihonyanagi et al. | 399/327 |
| 2005/0244200 | A1 | 11/2005 | Kanamori et al. | 399/333 |
| 2006/0008286 | A1 | 1/2006 | Nihonyanagi et al. | 399/69 |

FOREIGN PATENT DOCUMENTS

| | | | |
|---|---|---|---|
| JP | 8-220920 | | 8/1996 |
| JP | 10-69176 | | 3/1998 |
| JP | 10-149049 | | 6/1998 |
| JP | 2001005335 | A * | 1/2001 |
| JP | 2002-123117 | | 4/2002 |
| JP | 2002-221219 | | 8/2002 |
| JP | 2002-236426 | | 8/2002 |
| JP | 2003-29563 | | 1/2003 |
| JP | 2003-186327 | | 7/2003 |
| JP | 2003-270985 | | 9/2003 |
| JP | 2004029604 | A * | 1/2004 |

* cited by examiner

IMAGE HEATING APPARATUS HAVING HEATER FOR EXTERNALLY HEATING FIXING ROLLER

BACKGROUND OF THE INVENTION

1. Field of the Invention

The present invention relates to an image heating apparatus for heating a toner image formed on a recording material, and more particularly to an image heating apparatus adapted for use as a fixing apparatus to be mounted on an image forming apparatus such as a copying apparatus or a printer.

2. Related Background Art

As a fixing apparatus equipped in an image forming apparatus of electrophotographic process or electrostatic recording process, there has been widely employed a heat fixing device of so-called heat roller type, in which a recording material bearing an unfixed toner image is passed through a nip portion formed by a fixing roller and a pressure roller which are rotated in a mutually pressed state, thereby fixing the unfixed toner image onto the recording material as a permanent image.

On the other hand, a reduction in the electric power consumption is strongly desired as a recent environmental issue while a high image quality and a high speed in the image output are requested from market demands. Thus, various improvements are being tried in the heat fixing apparatus of the aforementioned heat roller type, in order to meet such requirements for the decreased electric power consumption and for the high image quality and the high speed.

The present applicant has proposed, in Japanese Patent Application Laid-Open No. 2003-182367, an image heating apparatus capable, as a fixing apparatus, of achieving an image output with a high image quality at a high speed, while maintaining a reduced electric power consumption and a shortened heating time. This fixing apparatus, as shown in FIG. 11, is provided with a fixing roller 20 having an elastic layer 22, a heating member 24 in contact with an external surface of the fixing roller 20 thereby forming a heating nip N, and a pressure member 30 maintained in a pressurized contact with the fixing roller thereby forming a fixing nip portion (conveying rip portion) M, in which a recording material P bearing an unfixed toner image t is pinched and conveyed to achieve heat fixation (apparatus of this type being hereinafter called "external heating type").

Also a heater 26 equipped on the heating member 24 is of a plate shape of a low heat capacity, of such a type generating heat in sliding contact with the heating nip N. Such configuration allows to achieve a higher energy density at the heating nip N in comparison with a structure of heating the surface of the heating roller by a heat roller in contact with the surface of the fixing roller, thereby enabling to promptly heating the surface of the fixing roller.

Also the contact of the elastic member 22 of the fixing roller with the recording material P or the toner t is equivalent to that in a heat roller type having an elastic layer, as employed in a prior high-speed apparatus, so that a high image quality can be maintained even for a higher speed in the image forming apparatus. Thus, such system is capable of simultaneously satisfying all the requirements, such as a reduction in the start-up time, a reduction in the electric power consumption, and a high-quality image output in a high-speed operation.

However, in the fixing apparatus shown in FIG. 11, in the heat fixation of a recording material, the toner on the recording material may be offset to the fixing roller, and such offset toner is deposited onto the surface of the heating member by the frictional contact between the heating member and the fixing roller. As the heat fixing operation is repeated, such offset toner is accumulated on the surface of the heating member, and, upon exceeding a certain amount, is peeled from the surface of the heating member and transferred onto the recording material thereby forming an image defect.

SUMMARY OF THE INVENTION

The present invention has been made in consideration of the aforementioned drawbacks, and an object of the present invention is to provide an image heating apparatus capable of suppressing a stain on the recording material, caused by a toner offset to the image heating apparatus.

Another object of the present invention is to provide an image heating apparatus of external heating type, capable of suppressing an accumulation of the toner deposited onto heating means of such image heating apparatus.

A further purpose of the invention is to provide an image heating apparatus for heating a toner image formed on a recording material, including: a rotatable member; heating means which heats an outer peripheral surface of the rotatable member, the heating means including a heater for forming a heating nip portion in cooperation with the rotatable member; back-up means which forms a conveying nip portion in cooperation with the rotatable member, the conveying nip portion conveying the recording material; and control means which controls a temperature of the heater and a rotation of the rotatable member; wherein the apparatus has a cleaning mode to remove toner from the heating means, and the control means rotates or reversely rotates the rotatable member in a condition that the heater dissipates heat in the cleaning mode.

Still other objects of the present invention will become fully apparent from the following detailed description to be taken in conjunction with the accompanying drawings.

DETAILED DESCRIPTION OF THE PREFERRED EMBODIMENTS

In the following, embodiments of the present invention will be explained with reference to the accompanying drawings.

(Embodiment 1 )

(1) Example of Image Forming Apparatus

Figure 1:
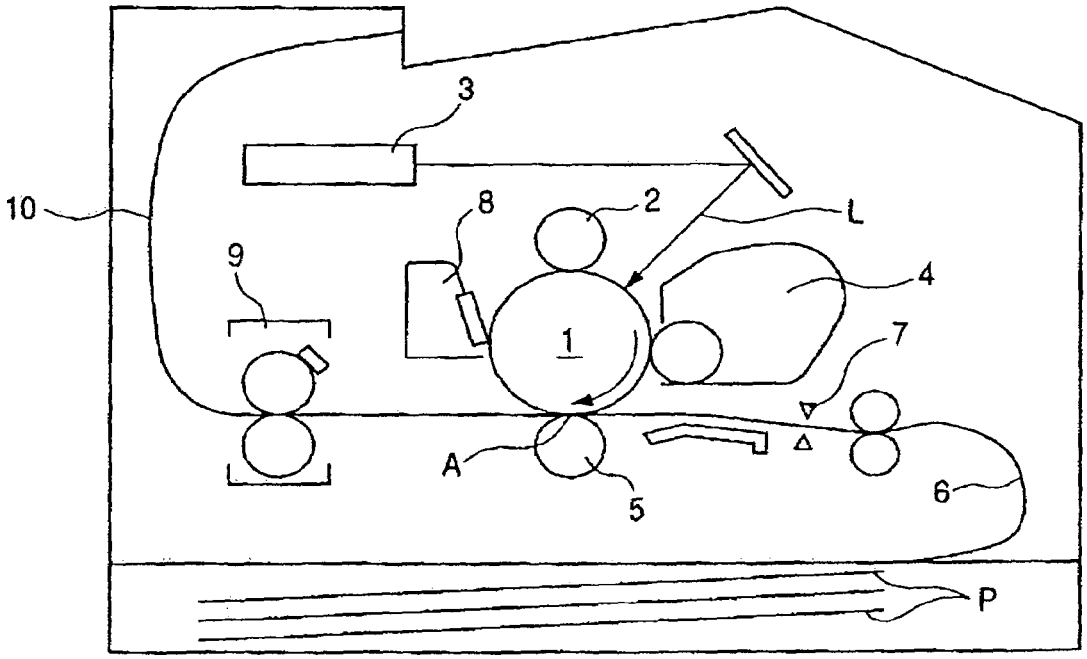
FIG. 1 is a schematic view showing a configuration of an image forming apparatus.

FIG. 1 is a schematic view showing a configuration of an image forming apparatus. The image forming apparatus of the present embodiment is a laser beam printer utilizing an electrophotographic process of transfer type.

An electrophotographic photosensitive member of a rotary drum shape (hereinafter called photosensitive drum) serving as an image bearing member is constituted of a photosensitive material such as an OPC, amorphous Se or amorphous Si formed on a cylindrical substrate such as of aluminum or nickel.

The photosensitive drum 1 is rotated with a predetermined peripheral speed clockwise as indicated by an arrow, and a surface thereof is at first uniformly charged at predetermined polarity and potential by a charging roller 2 serving as a charging apparatus.

Then the charged surface is subjected to an exposure corresponding to image information by a laser scanner 3. The laser scanner 3 irradiates the uniformly charged surface of the rotary photosensitive drum 1 with a laser beam L which is on/off controlled (modulation control) according to a time-sequential electrical digital image signal of image information. Thus the potential of the uniformly charged surface of the photosensitive drum 1 is attenuated in an exposed portion, whereby an electrostatic latent image is formed corresponding to the image information, on the photosensitive drum.

The electrostatic latent image is developed and rendered visible as a toner image in a developing apparatus 4. Such development can be executed for example by a jumping development, a two-component development or a FEED development, and an imagewise exposure and a reversal development are often employed in a combination.

The visible toner image is transferred, at a transfer nip portion A formed by a pressed contact of the photosensitive drum 1 and a transfer roller 5 constituting a contact transfer apparatus pressed thereto, from the surface of the photosensitive drum 1 onto a surface of a recording material P which is supplied at a controlled timing from a sheet feeding mechanism 6 to the transfer nip portion.

More specifically, a timing of conveying of the recording material is controlled according to front end position information of the recording material P, detected by a sensor 7 in such a manner that the toner image on the photosensitive drum 1 coincides with a writing start position at the front end of the recording material. The recording material P conveyed at a predetermined timing is, at the transfer nip portion A, pinched and conveyed under a predetermined pressure by the photosensitive drum 1 and the transfer roller 5 whereby the toner image on the surface of the photosensitive drum 1 is transferred onto the recording material P by an electrical force and a pressure.

The recording material P, upon passing through the transfer nip portion A, is separated from the surface of the photosensitive drum 1 and conveyed to a heat fixing apparatus 9, in which the unfixed toner image is heat fixed as a permanent image on the surface of the recording material. The recording material subjected to image fixation is conveyed to a sheet discharging mechanism 10.

A transfer residual toner, remaining on the photosensitive drum 1 after the separation of the recording material, is removed by a cleaning apparatus 8 from the surface of the photosensitive drum 1, which is then used in image formation in repetition.

(2) Operation Sequence of Printer

In the following, an operation sequence of the above-described printer will be explained with reference to FIG. 2.

A: Pre multi-rotation step: This is a starting operation period (starting operation period or warming-up period) of the printer. In response to a turning-on of a main switch of the apparatus, a main motor of the apparatus is driven to rotate the photosensitive drum thereby executing preparatory operations for predetermined process devices.

B: Initial rotation step: This is a period for executing a pre-print operation. In case a print signal is entered during the pre multi-rotation step, this initial rotation step is executed in succession to the pre multi-rotation step. In case a print signal is not entered, the main motor is once deactivated to terminate the rotation of the photosensitive drum 1, and the printer is maintained in a stand-by (waiting) state until a print signal is entered. The initial rotation step is executed in response to an entry of a print signal.

C: Printing step (image formation step, imaging step): After the predetermined initial rotation step, there are executed an image formation step on the photosensitive drum 1, a transfer of the toner image formed on the photosensitive drum 1 onto the recording material P, and a fixing process for the toner image by the fixing means, whereupon a formed image is outputted. In a continuous print mode, the aforementioned printing step is repeatedly executed by a preset print number.

D: Sheet interval step: This is a sheet non-passing period in the transfer nip portion A, in a continuous printing mode, from a passing of a rear end of a recording material P through the transfer nip portion A to an arrival of a front end of a succeeding recording material P at the transfer nip portion A.

E: Post-rotation step: This is a period in which the main motor is maintained active to continue the rotation of the photosensitive drum 1 for a while after the end of the printing step for a last recording material P, in order to execute a predetermined post-operation.

F: Cleaning step (cleaning sequence): This is a period in which an offset toner, accumulated in the heating nip portion between the fixing roller and the heating member in the heat fixing apparatus 8, thereby cleaning the heating member. The cleaning step will be detailedly explained in the following.

G: Stand-by: After the end of the predetermined post-rotation step, the main motor is deactivated to terminate the rotation of the photosensitive drum 1, whereby the printer is maintained in a stand-by state until a next print start signal is entered.

In case of a single print only, the printer enters the stand-by state after executing the post-rotation step. In the stand-by state, the printer enters the initial rotation step upon receiving a print start signal.

The printing step C constitutes an image forming period, while the pre multi-rotation step A, the initial rotation step B, the sheet interval step D, the post-rotation step E and the cleaning step F constitute an image non-forming period (image non-formation state).

The main motor drives the photosensitive drum 1, the sheet feeding mechanism 6, the developing apparatus 4, the transfer apparatus 5, the heat fixing apparatus 9 and the sheet discharge mechanism 10.

(3) Heat Fixing Apparatus

Figure 3:
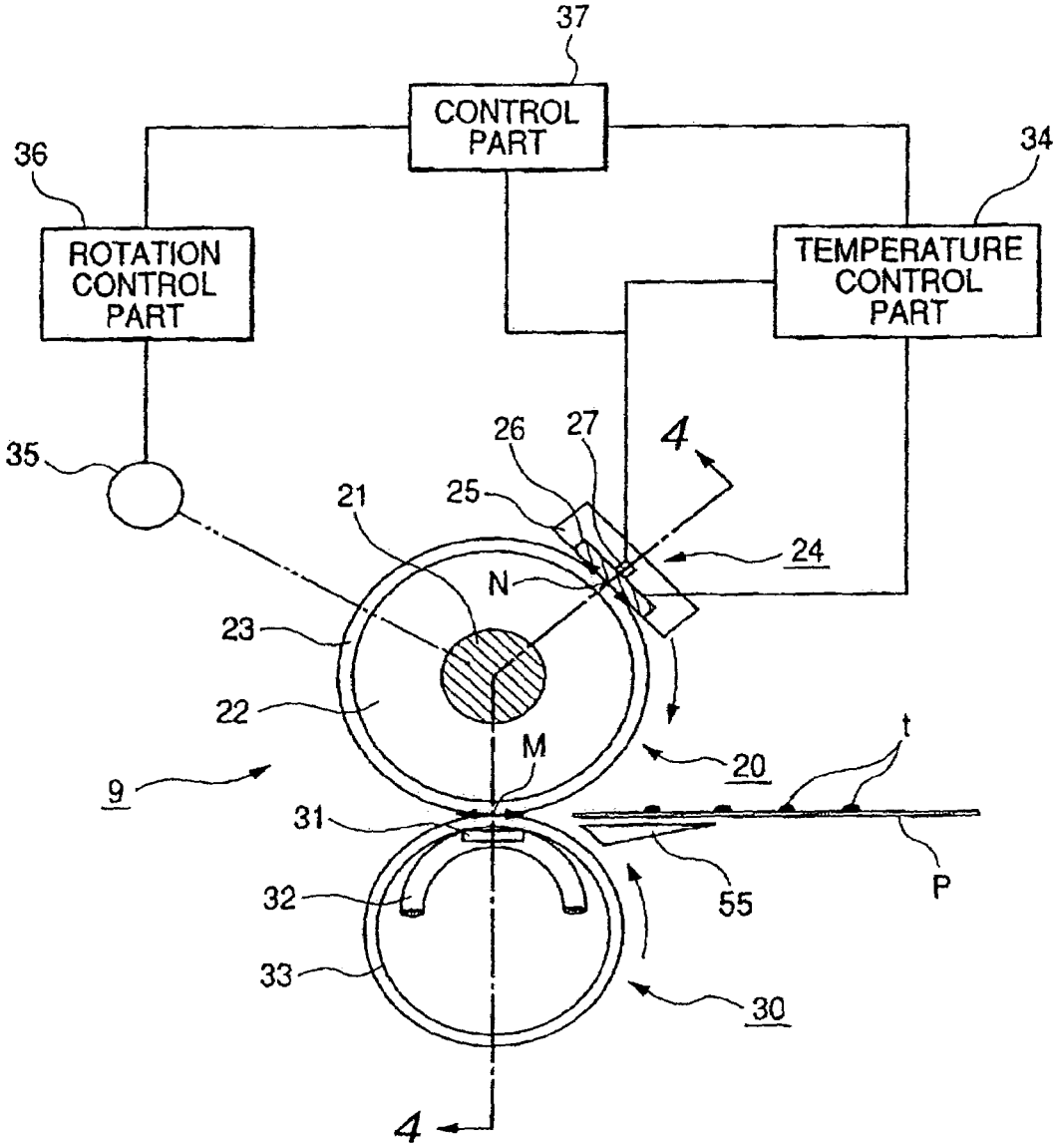
FIG. 3 is a schematic view showing a configuration of a heat fixing apparatus in the embodiment 1.
Figure 4:
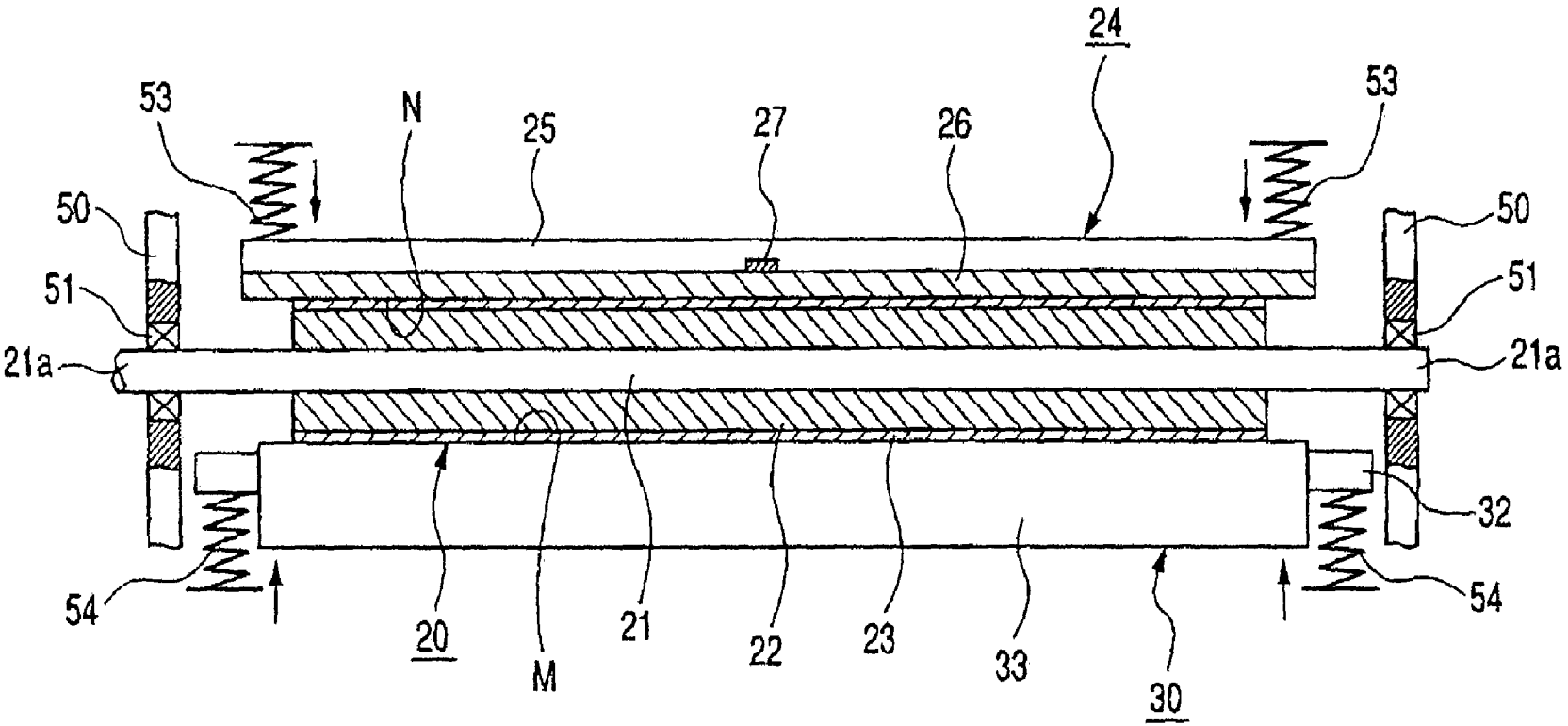
FIG. 4 is a schematic cross-sectional view of the heating fixing apparatus shown in FIG. 2, along a line B—B therein.

FIG. 3 is a schematic view of the heat fixing apparatus 6 of the present embodiment, and FIG. 4 is a schematic view of the heat fixing apparatus shown in FIG. 3 along a line B—B therein.

The heat fixing apparatus is principally provided with a fixing roller (rotatable member) 20 having an elastic layer, a heating member (heating means) 24 maintained in cfontact with an external surface (external periphery) of the fixing roller 20 to form a heating nip portion N thereby heating and causing a temperature elevation on the external surface of the fixing roller 20, and a pressure member (backup means) 30 in a mutual pressurized contact with the fixing roller 20 thereby forming a fixing nip portion (conveying nip portion) M.

1) Fixing Roller (Rotatable Member) 20

The fixing roller 20 is constituted of following members. It is basically constituted by forming, on an external surface or an external periphery of an aluminum or iron metal core 21, an elastic layer 22 (solid rubber layer) formed by silicone rubber, or an elastic layer (sponge rubber layer) formed by foaming silicone rubber for providing a heat insulating effect, or an elastic layer (bubbled rubber layer) formed by dispersing bubbles within a silicone rubber layer by any method thereby increasing the heat insulating effect.

However, the fixing roller, in case having a large heat capacity and also even a slightly large thermal conductivity, tends to absorb the heat received from the external surface whereby the surface temperature of the fixing roller cannot be easily elevated. For this reason, the elastic layer 22 is advantageously formed by a material of a low heat capacity, a low thermal conductivity and a high heat insulating effect as far as possible, in order to shorten a time required by the surface temperature of the fixing roller to reach a predetermined temperature.

The thermal conductivity is 0.25 to 0.29 W/m·K in silicone solid rubber, while that in sponge rubber and bubbled rubber is 0.11 to 0.16 W/m·K, namely about a half of that in the solid rubber.

Also a specific gravity, relating to the heat capacity, is about 1.05 to 1.30 in the solid rubber while it is about 0.75 to 0.85 in the sponge rubber or in the bubbled rubber.

Therefore, the elastic layer 22 is preferably constituted of a sponge rubber layer or a bubbled rubber layer of a high heat insulating effect, having a thermal conductivity of about 0.15 W/m·K or less and a specific gravity of 0.85 or less.

Also in the fixing roller 20, a smaller external shape (external diameter) allows to suppress the heat capacity, but a certain diameter is necessary since the heating nip N becomes difficult to form at an excessively small diameter.

Also in the elastic layer 22, a certain appropriate thickness is necessary as an excessively thin layer stimulates heat dissipation to the metal core 21.

In consideration of the foregoing, the present embodiment employs an elastic layer 22 formed with a bubbled rubber of a thickness of 4 mm and a fixing roller 20 with an external diameter of 20 mmϕ in order to form an appropriate heating nip N and to suppress the heat capacity.

On the aforementioned elastic layer 22, there is formed a releasing layer 23 of a fluorinated resin such as perfluoroalkoxy resin (PFA), polytetrafluoroethylene (PTFE) or tetrafluoroethylene-hexafluoropropylene resin (FEP). The releasing layer 23 may be formed as a tube or formed by coating, but a tube is superior in durability.

The fixing roller 20 of the aforementioned configuration is rotatably supported, at both ends 21*a* of the metal core 21, by bearings 51 on a pair of roller support members 50 as shown in FIG. 4.

2) Heating Means 24

The heating means 24 is constituted of following members. A plate-shaped heater (heating member) 26 of a low heat capacity is maintained, at a surface at the side of the fixing roller 20, in contact with the external surface of the fixing roller 20, thereby heating the external surface thereof. The heater 26 is constituted by forming, on a surface of a highly insulating ceramic substrate such as of alumina or aluminum nitride, a heat-generating resistor layer such as of Ag/Pd (silver-palladium), $RuO_2$ or $Ta_2N$ for example by screen printing along a longitudinal direction. The heat-generating resistor layer has a line or stripe shape with a thickness of about 10 μm and a width of about 1 to 5 mm.

On the surface of the heater 26, there is preferably formed a protective slidable layer in order to avoid an abrasion of the releasing layer 23 of the fixing roller 20 by friction. The protective layer can be formed, for example, by coating a fluorinated resin such as perfluoroalkoxy resin (PFA), polytetrafluoroethylene resin (PTFE), tetrafluoroethylene-hexafluoropropylene resin (FEP), polychlorotrifluoroethylene resin (CTEF) or polyvinylidene fluoride (PVDF) singly or in a mixture, a dry film lubricant constituted for example of graphite, diamon-like carbon (DLC) or molybdenum disulfide, or a glass coating.

A heat insulating stay holder 25 is provided for supporting the heater 26. The heat insulating stay holder 25 is pressed, at both ends thereof as shown in FIG. 4, toward the fixing roller 20 by pressurizing means (such as coil springs) 53, and a heating nip portion N is formed by such pressure between the heater 26 and the fixing roller 20. The heat insulating stay holder 25 has a function of preventing heat dissipation in a direction opposite to the heating nip portion N, and can be formed for example with a liquid crystal polymer, phenolic resin, PPS, or PEEK.

On the rear surface of the heater 26, there is provided a temperature detector (temperature detection means) 27 such as a thermistor for detecting the temperature of the ceramic substrate heated by the heat generated in the heat-generating resistor layer. In response to a signal from the temperature detector 27, a temperature controller (temperature control means) 34 shown in FIG. 3 suitably controls a duty ratio or a frequency of a voltage applied to the heat-generating resistor layer from unillustrated terminals provided on both ends thereof, thereby achieving a temperature control of the heater 26. More specifically, the temperature controller 34 so controls the current supply to the heater 26 that the temperature detected by the temperature detector 27 is maintained at a set temperature. In the fixing apparatus of the present embodiment, the temperature control of the heater 26 allows to maintain, within the surface of the fixing roller 20, a surface portion thereof moving from the heat nip portion N toward the conveying nip portion M at a temperature suitable for fixing. A DC current supply from the temperature detector 27 to the temperature controller 34 is achieved by an unillustrated DC power supply and DC electrodes, across an unillustrated connector.

3) Pressurizing Member (Backup Means) 30

The pressurizing member 30 has a following configuration. A sliding film (flexible sleeve) 33 of a cylindrical shape is constituted of a resinous film having a heat-resistant and thermoplastic base layer for example of polyimide, polyamidimide, PEEK, PPS, PFA, PTFE or FEP. An appropriate thickness range of the film is equal to or larger than 20 μm but smaller than 150 μm, in consideration of the strength. An external shape (external diameter) of the sliding film is made smaller than the external shape of the fixing roller 20.

There are also provided a slidable plate (slidable member) provided inside the sliding film 33, and a heating insulating stay holder 32 supporting the slidable plate 31.

The heat insulating stay holder 32 is pressed, at both ends thereof as shown in FIG. 4, toward the fixing roller 20 by pressurizing means (such as coil springs) 54, and a fixing nip portion (conveying nip portion) M is formed between the heater 26 and the fixing roller 20, across the sliding film 33. The heat insulating stay holder 32, as in case of the stay holder 25 for the heating member 24, is formed by a heat-insulating and heat-resistant resin such as a liquid crystal polymer, phenolic resin, PPS, or PEEK. Therefore, the sliding film 33 is in contact, at the internal peripheral surface thereof, with the slidable plate 31 and, at the external peripheral surface thereof, with the external periphery of the fixing roller 20.

The slidable plate 31 is formed with a material showing a low friction with the sliding film 33 and having a heat insulating property, such as a liquid crystal polymer, phenolic resin, PPS or PEEK as in the case of the stay holder 32, and is preferably coated, on the surface thereof, with a slidable layer for reducing the friction resistance Examples of such layer is similar to those of the slidable layer provided on the surface of the heater 26, and will not, therefore, be explained further.

In the present embodiment, the slidable plate 31 and the heat insulating stay holder 32 are constructed as separate members, but it is also possible to integrally form these members and to coat the aforementioned slidable layer in a sliding contact part, thereby achieving a further cost reduction. Also between the sliding film 33 and the slidable plate 31, a small amount of lubricant such as grease, in order to reduce the friction resistance between the sliding film 31 and the slidable plate 31.

As the present embodiment adopts a fixing roller with a diameter ϕ of 20 mm, an angle of 120° between a line connecting the center of the fixing roller 20 and the center of the heating nip portion N and a line connecting the center of the fixing roller 20 and the center of the fixing nip portion M, and a conveying speed of 250 mm/sec of the recording material, a time required by the surface of the fixing roller 20 to move from the center of the heating nip portion N to the center of the fixing nip portion M is as short as 0.08 seconds. Besides, as the elastic layer 22 of the fixing roller 20 is composed, as explained in the foregoing, of a sponge rubber layer or a bubbled rubber layer of a thermal conductivity of about 0.15 W/m·K or less and a specific gravity of 0.85 or less, the surface area of the fixing roller, heated by the heater 26 in the heating nip portion N, can reach the fixing nip portion M almost without a temperature loss.

4) Operation

In such configuration, the fixing roller 20 is rotated, through the longitudinal end and the metal core 21 thereof, by the main motor (drive means) 35 of the apparatus shown in FIG. 3, in a clockwise direction indicated by an arrow (conveying direction of the recording material). The main motor 35 is controlled by a rotation controller 36. Also the temperature controller 34 and the rotation controller 36 are managed by a control unit 37. By the rotation of the fixing roller 20, the sliding film 33 at the side of the backup means 30 receives a rotating force at the fixing nip portion M and is driven counterclockwise outside the heat insulating stay holder 32 in sliding contact with the surface of the slidable plate 31.

Also a current is supplied to the heat generating resistor layer of the heater 26 of the heating means 20 to promptly heat the heater 26 to a predetermined control temperature (set temperature), and a temperature control system including the temperature detector 27 and the temperature controller 34 controls the current supply to the heat generating resistor layer in such a manner that the heater 26 is maintained at a predetermined control temperature.

Also by the heat generation of the heater 26, the external surface of the rotating fixing roller 20 is externally heated at the heating nip portion N and is rapidly heated to the predetermined fixing temperature. In the fixing apparatus, as explained above, the temperature control of the heater 26 allows to maintain, within the surface of the fixing roller 20, a surface portion thereof moving from the heat nip portion N toward the conveying nip portion M at a temperature suitable for fixing.

In a state where the fixing roller 20 is rotated and the external surface thereof is heated to the predetermined fixing temperature, a recording material P bearing an unfixed toner image is introduced, from the side of the transfer nip portion A and along a heat resistant fixing entrance guide 55, into the fixing nip portion M formed by the fixing roller 20 and the pressure roller 30, and is pinched and conveyed by the fixing nip portion M. Thus the unfixed toner image t is fixed, by heat and pressure in the fixing nip portion M, onto the recording material P.

Figure 5:
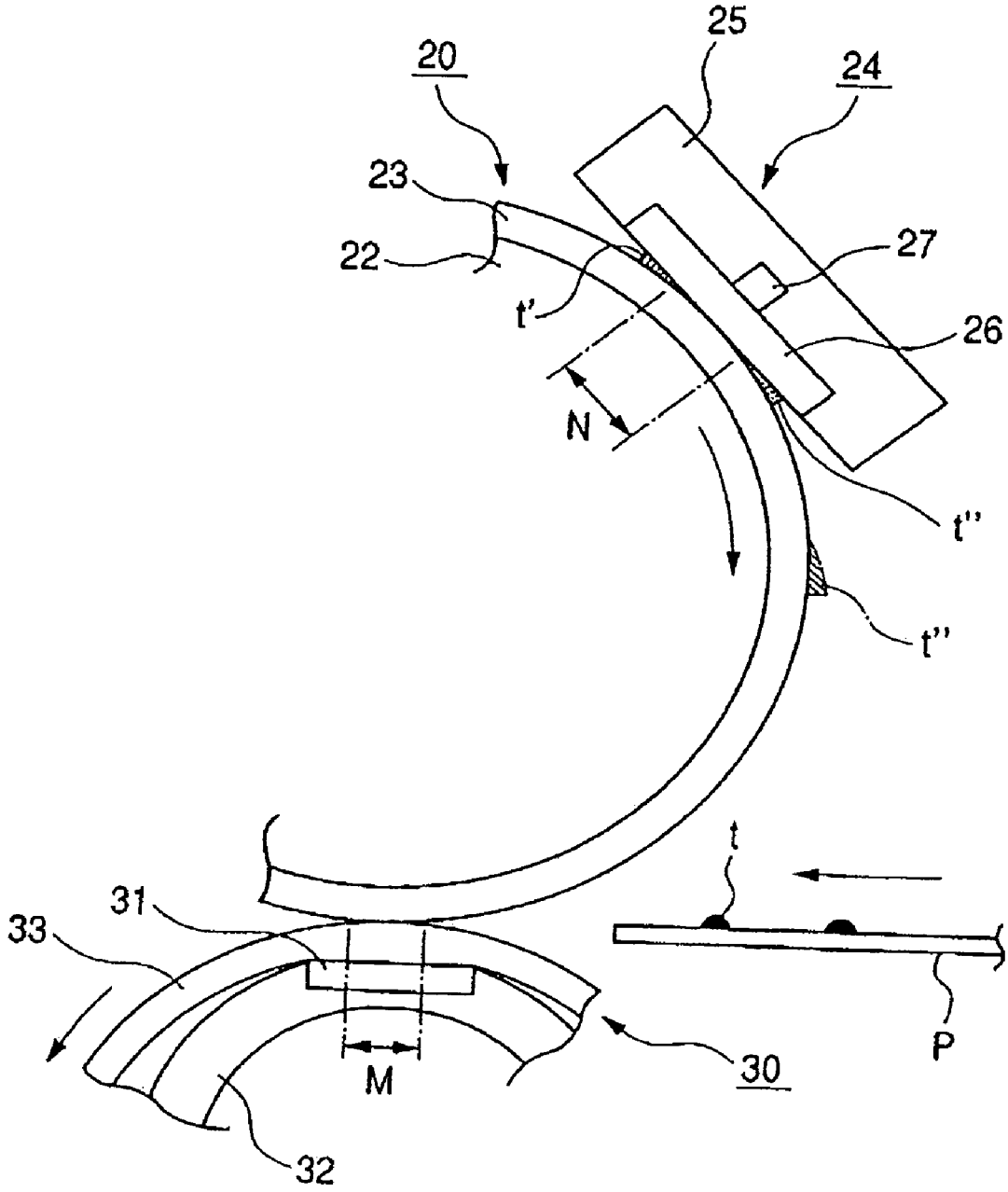
FIG. 5 is a magnified view of a heating nip portion shown in FIG. 2.

In the heat fixing operation of the unfixed toner image by pinching and conveying the recording material P in the fixing nip portion M, a small amount of offset toner, coming from the recording material P, is accumulated on a portion of the heater 26 in the heating nip portion N. This phenomenon will be explained with reference to FIG. 5, which is a magnified view of the heating nip portion N formed by the pressed contact of the heater 26 and the fixing roller 20. The offset toner t of the small amount on the fixing roller 20 is at first blocked at the upstream side of the heating nip portion N in the rotating direction of the fixing roller, then fused by heating and accumulated, as indicated by t', on the surface of the heater 26 in the upstream side of the heating nip portion N in the rotating direction of the fixing roller. Also a part of thus accumulated toner t' gradually moves, along with the rotation of the fixing roller 20, through the contact portion of the heater 26 and the fixing roller 20 in the heating nip portion N toward the downstream side of the heating nip portion N in the rotating direction of the fixing roller, and is accumulated on the surface of the heater 26 after the heating nip portion. N, as indicated by t". The toner t" accumulating in the downstream side of the heating nip portion N is much larger in amount than the toner t' accumulating in the upstream side. When the printing operation is continued in this state, the toner t", accumulating on the surface of the heater 26 at the downstream side in the rotating direction of the fixing roller, is returned onto the surface of the fixing roller 20, then transported to the fixing nip portion M and is transferred onto a surface (image printing surface) of the recording material at the side of the fixing roller 20, thereby staining the recording material P. Although the toner t', accumulating at the upstream side of the heating nip portion N, is gradually moved in the fixing step to the downstream side of the heating nip portion N thereby merely forming the deposited toner t", but it is desirable to remove also the accumulated toner t' in the upstream side as well as the accumulated toner t" in the downstream side from the heater surface.

5) Control Mode (Cleaning Mode)

Figure 6:
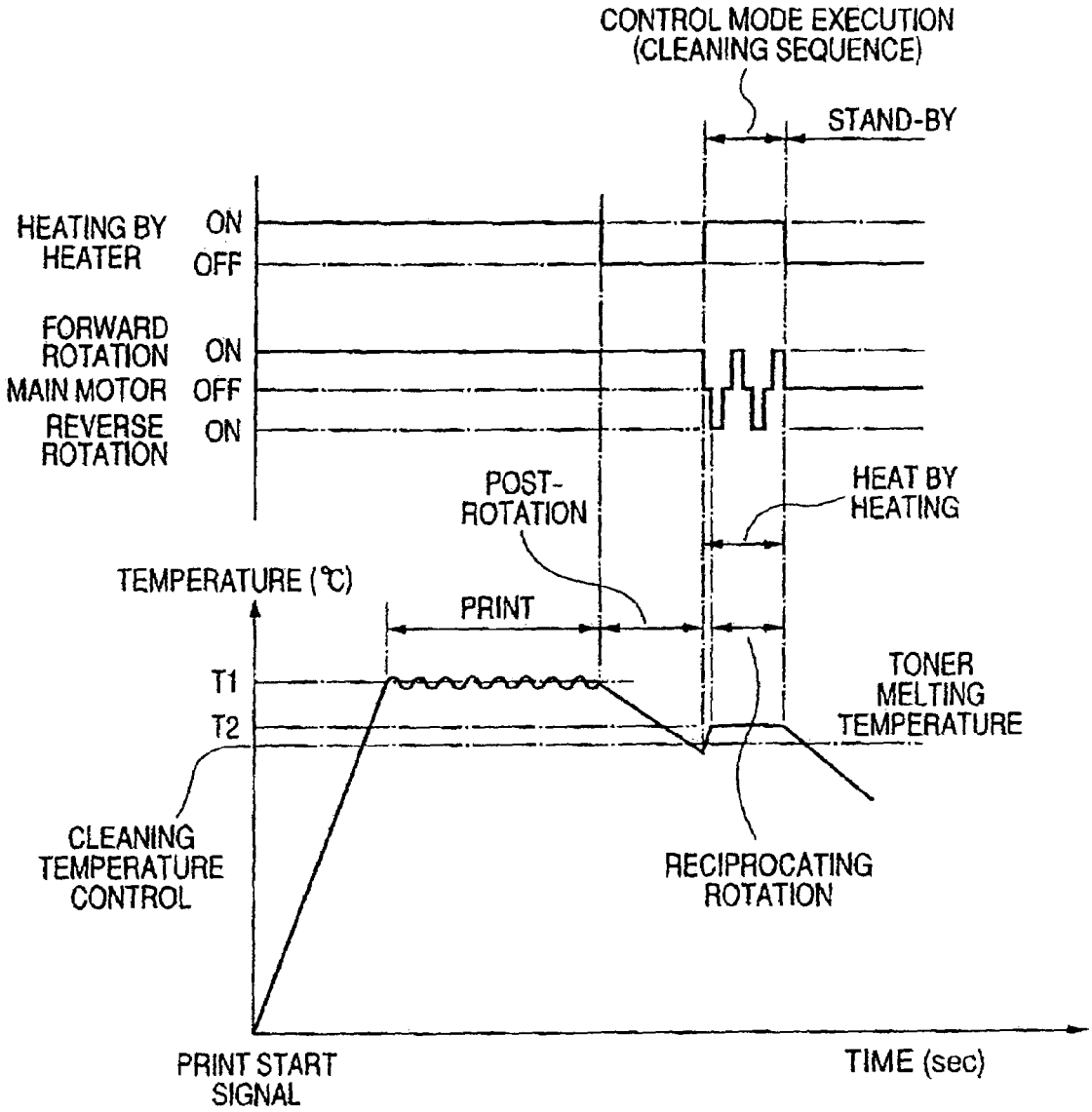
FIG. 6 is a schematic view showing a temperature control of a heater in a control mode, a temperature behavior of the heater, and a rotation control of a fixing roller.

In the present embodiment, therefore, the heater 26 is turned off simultaneously with the end of the printing operation, and, after the post-rotation step explained in the foregoing, there is executed a control mode (cleaning sequence) for cleaning the heater 26 by a controller 37 shown in FIG. 3. (Thus, the cleaning mode in the present embodiment is automatically executed after the heating step for heating the toner image on the recording material is completed.) FIG. 6 schematically shows a temperature control for the heater 26 in case of the aforementioned control mode, a temperature behavior of the heater 26 and a rotation control for the fixing roller 20.

When the control mode is started, the temperature controller 34 starts a current supply to the heat-generating resistor layer of the heater 26, thereby initiating a control for heating the heater 26 to a predetermined temperature T2 higher than the fusing temperature of the toner and maintaining such temperature T2. Such heating mutually combines the toners deposited on the surface of the heater 26, thereby facilitating separation from the surface of the heater 26. The temperature T2 may be higher or lower than the set temperature T1 of the heater in the fixing step (image heating step) as long as it is higher than the fusing temperature of the toner. In the present embodiment, the temperature T2 is selected lower than the temperature T1. While the heater 26 is controlled at the temperature T2, namely while the toners t' and t" are in the fused state, the fixing roller 20 is rotated in the forward and reverse directions. A rotation of the fixing roller causes a friction between the fixing roller and the surface of the heater, whereby the toner deposited on the surface thereof is peeled off and is transferred onto the surface of the fixing roller. Rotation angles (rotation amounts) in the forward and reverse rotations need only that a surface area of the fixing roller in contact with the heater 26 at the start of the cleaning mode can reach the fixing nip portion M, and each is preferably within 360°. Thus the toner sticking to the surface of the fixing roller 20 is carried to the fixing nip portion M, and, at the fixing nip portion M, is deposited onto the surface of the film 33 of a temperature lower than that of the fixing roller.

In the aforementioned cleaning temperature control, as shown in FIG. 6, the rotation controller 36 turns on and off the main motor 35 alternately clockwise (reverse direction in FIG. 6) and counterclockwise (forward direction in FIG. 6), thereby causing two cycles of reciprocating rotation in the fixing roller 20.

More specifically, the main motor 35 is turned on to rotate the fixing roller 20 counterclockwise (opposite to the conveying direction of the recording material) by a full turn (360°) and is then turned off. The counterclockwise rotation of the fixing roller 20 carries the toner t', transferred from the surface of the heater 26 at the upstream side in the rotating direction of the fixing roller 20, to the fixing nip portion M.

The toner t', carried to and upon reaching the fixing nip portion M, is transferred therein onto the surface of the pressure member 30 (namely the surface of the film 33) of a temperature lower than that of the fixing roller 20.

Figure 7A:
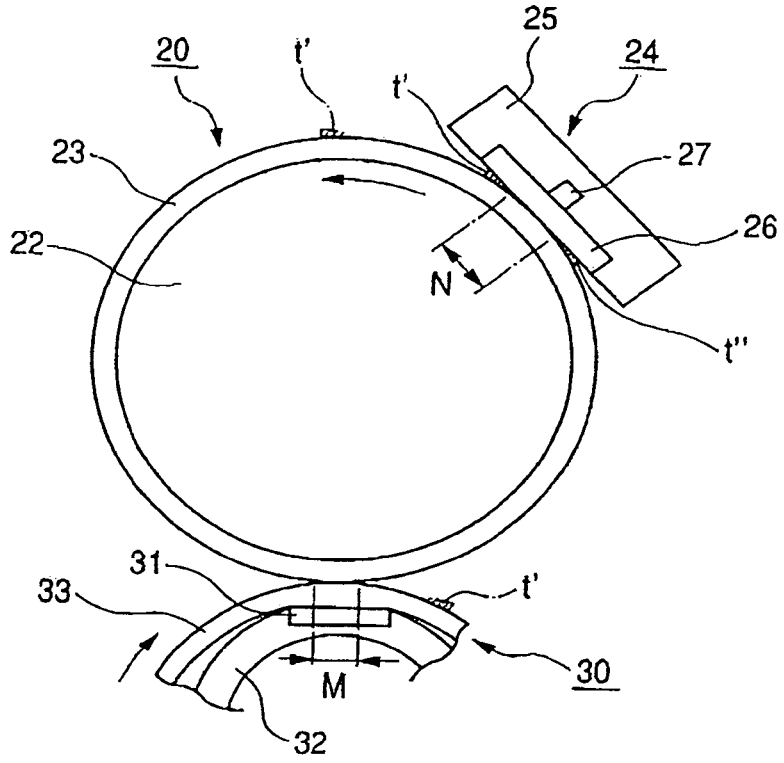
FIG. 7A is a view showing an operation of transferring a toner, deposited in an upstream side of the heater in a rotating direction of the fixing roller, from the fixing roller to a pressure member.
Figure 7B:
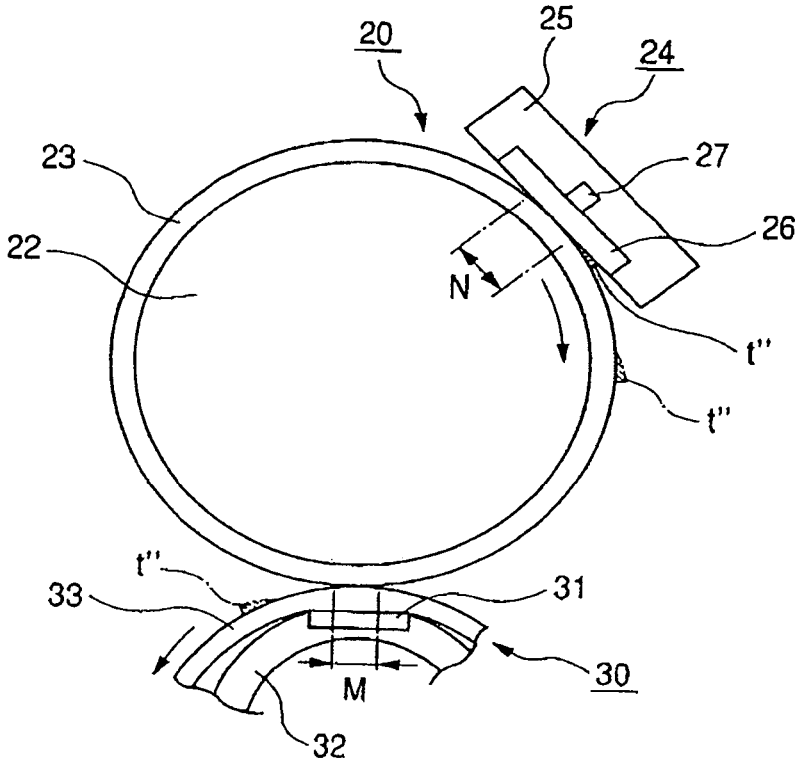
FIG. 7B is a view showing an operation of transferring a toner, deposited in a downstream side of the heater in a rotating direction of the fixing roller, from the fixing roller to a pressure member.

Then the rotation controller 36 turns on the main motor 35 as indicated in FIG. 7B to rotate the fixing roller 20 clockwise by a full turn (360°) and then turns off the main motor 35. The clockwise rotation of the fixing roller 20 carries the toner t", transferred from the surface of the heater 26 at the downstream side in the rotating direction of the fixing roller 20, to the fixing nip portion M.

The toner t" supported on the fixing roller 20, upon reaching the fixing nip portion M, is transferred therein onto the surface of the pressure member 30 of a temperature lower than that of the fixing roller 20.

The rotation controller 36 repeats the aforementioned on/off operations of the main motor 35, whereby the fixing roller 20 is rotated in two reciprocating cycles in the counterclockwise and clockwise directions.

When two reciprocating cycles are completed, the rotation controller 36 turns off the main motor 35 and, at the same time, the temperature controller 34 turns off the current supply to the heat-generating resistor layer of the heater 26, whereby the control mode is terminated.

Upon completion of the control mode, the image forming apparatus enters a stand-by state.

Through the aforementioned control mode (cleaning mode), the toners t' and t" are supported on the film 33.

Figure 7C:
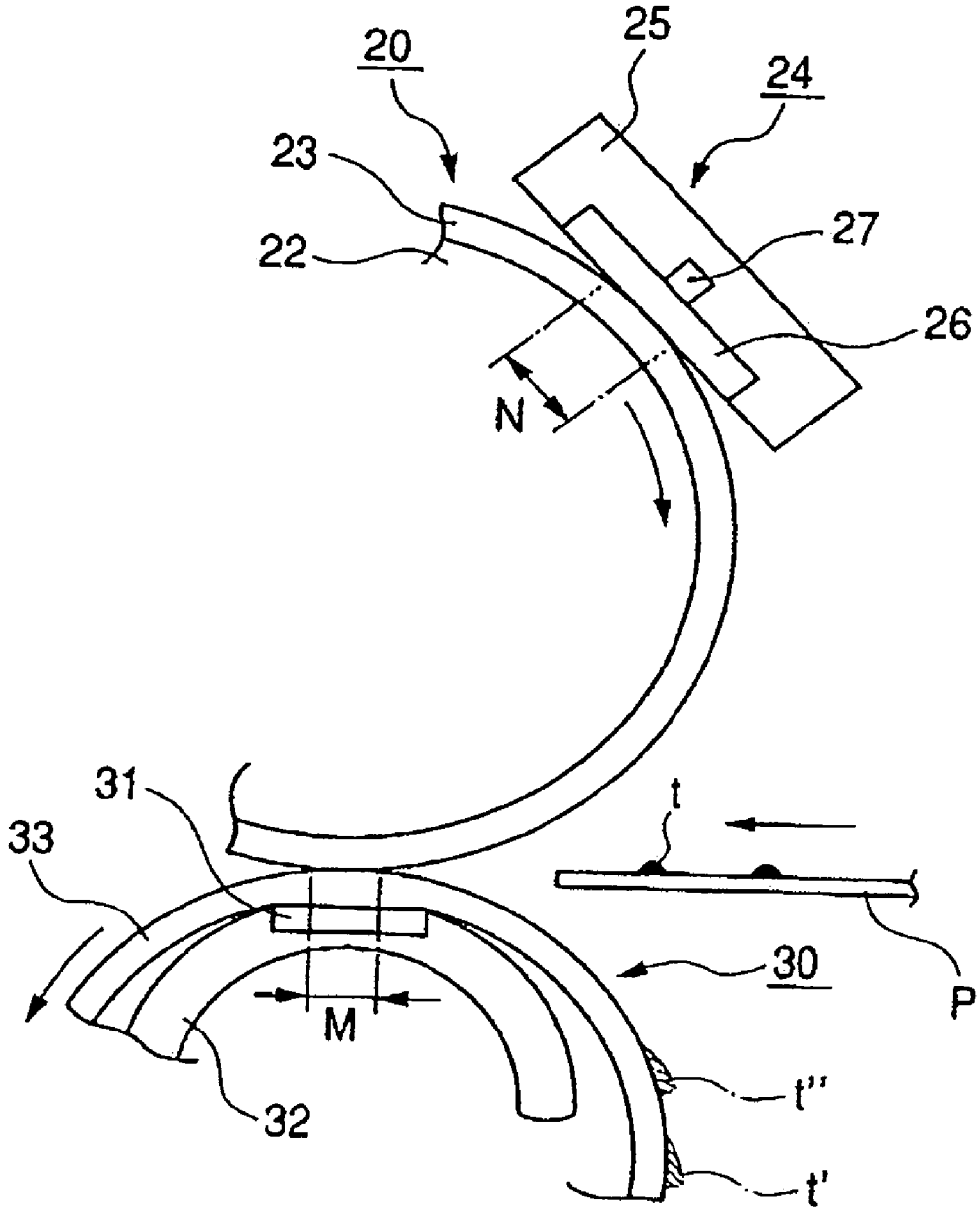
FIG. 7C is a view showing an operation of transferring a toner, transferred onto the pressure member, onto a recording material.

When a print start signal is entered in the aforementioned state where the toners t' and t" are deposited on the film 33, a next printing operation is initiated after a initial rotation step, and a recording material P is introduced into the fixing nip portion M of the heat fixing apparatus 9 as shown in FIG. 7C. In the initial rotation step, the heater 26 generates heat to heat the fixing roller 20, and, in the fixing nip portion M, the film 33 is also heated by the heat received from the fixing roller 20. As the recording material P is at the normal temperature, the toners t', t" transferred onto the surface of the film 33 are transferred, in the fixing nip portion M, from the surface of the film 33 onto a surface (image non-recording surface) of the recording material P, at the side of the film 33, having a temperature lower than that of the film 33, and is discharged together with the recording material P. Thus, the cleaning mode (control mode) of the present embodiment allows to discharge the toner, deposited in the heater 26, together with the recording material P at the printing operation.

6) Evaluation

In order to investigate the relationship between the controlled temperature T2 for cleaning and the cleaning performance, an intermittent sheet-passing durability test (2 sheet/minute) was conducted, Also the rotation (reciprocating rotation) of the fixing roller 20 after the post-rotation step in the image forming apparatus was executed by rotating the fixing roller 20 by 360°, then reversing the fixing roller 20 by 360°, and executing these operations in two cycles. This evaluation employed a monochromatic crushed toner with a fusing temperature of 90 to 100° C. As the recording material, there were employed paper sheets having a relatively rough surface (rough paper) of a letter size, with a basis weight of 90 g/m$^2$. In order to achieve satisfactory fixation on this recording material with a process speed of 250 mm/sec, it: was necessary to maintain the fixing nip portion M at a temperature of 180° C., corresponding to a heater temperature of 230° C. Thus the heater 26 at the printing operation (image heating operation) was set at a set temperature (controlled temperature) T1 of 230° C., and such temperature setting maintains the fixing nip portion M at a temperature of about 180° C. in the printing operation.

Results are shown in Table 1.

TABLE 1

| Control temperature | no cleaning | 100° C. | 150° C. | 200° C. |
|---|---|---|---|---|
| Image defect | caused after 2,000 sheets | caused after 5,000 sheets | not caused after 20,000 sheets | not caused after 20,000 sheets |

In case the cleaning was not executed, an image defect where the accumulated toner was deposited on the image side of the recording material was caused after printing on 2,000 sheets. When the cleaning temperature T2 was set at 100° C., the image defect was caused after printing on 5,000 sheets. When the cleaning temperature T2 was set at 150° C. or 200° C., the image defect was not caused even after printing on 20,000 sheets. It was therefore identified that the number of prints until the generation of the image defect could be increased by executing the aforementioned cleaning mode with a temperature T2 set at least at the fusing temperature of the toner (100° C.). It was also possible, by setting the cleaning temperature T2 at 150° C. or higher, to effectively prevent the generation of the image defect and to effectively discharge the offset toner, deposited on the heater surface, by the transfer onto the image non-forming side of the recording material.

The cleaning sequence of the present embodiment allows to effectively decrease the amount of the offset toner sticking to the heater, even in the presence of fluctuations for example in the roughness of the surfacial coating on the heater 26, thereby dispensing with an unnecessary precision on the surface coating of the heater to enable an improvement in the production yield of the heater and a cost reduction therein.

Figure 2:
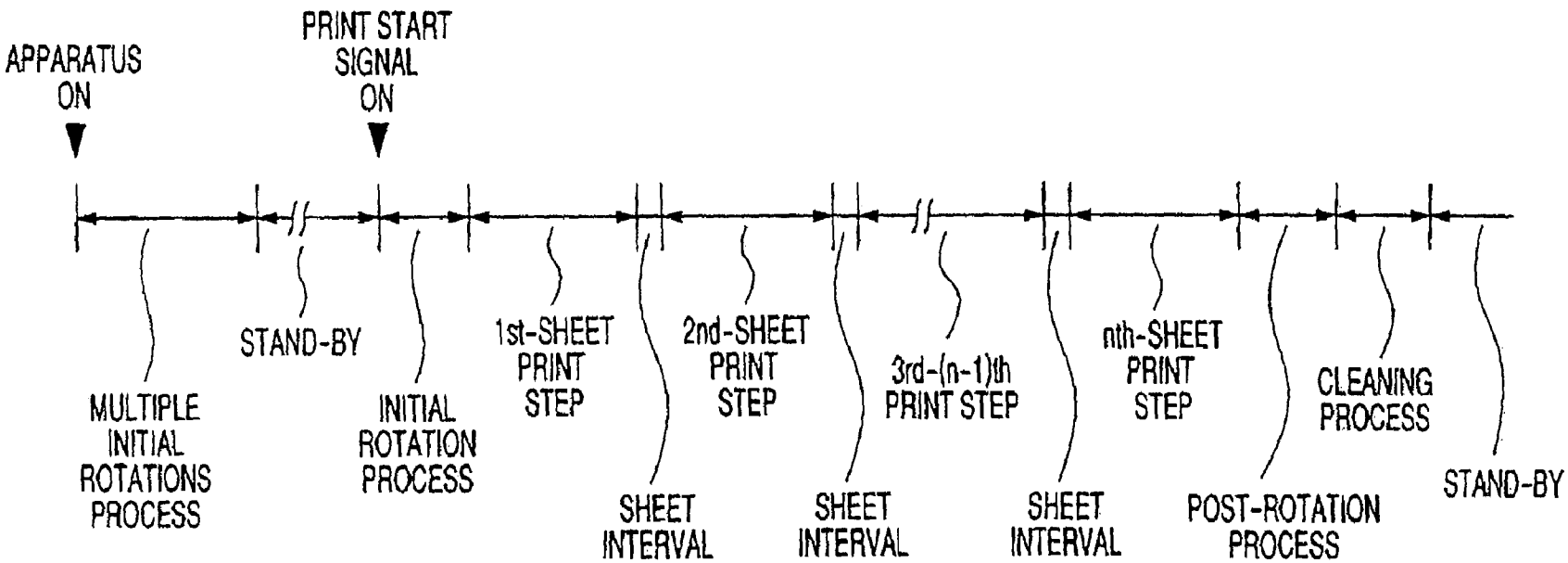
FIG. 2 is a view showing an operation sequence of an image forming apparatus of an embodiment 1.

The control mode of the present embodiment is not limited to after the post-rotation step but may also be executed for example after the pre multi-rotation step, the stand-by state or the initial rotation step shown in FIG. 2.

(Embodiment 2 )

In the following, there will be explained a second embodiment of the present invention. In the configuration of the entire image forming apparatus and the configuration of the heat fixing apparatus in the present embodiment, components same as those in the foregoing first embodiment will be represented by same numbers and will not be explained further.

In the present embodiment, in case of a continuous printing operation, the aforementioned control mode is executed after a printing operation of a certain number of sheets. The cleaning sequence after the printing operation, shown in the embodiment 1, cannot be executed during a continuous printing operation, so that the offset toners t', t" are accumulated on the heater 26. Therefore, in a continuous printing operation, the sheet feeding is interrupted and the heater is cleaned when the number of sheets exceeds a certain number.

1) Operation Sequence of Printer

Figure 8:
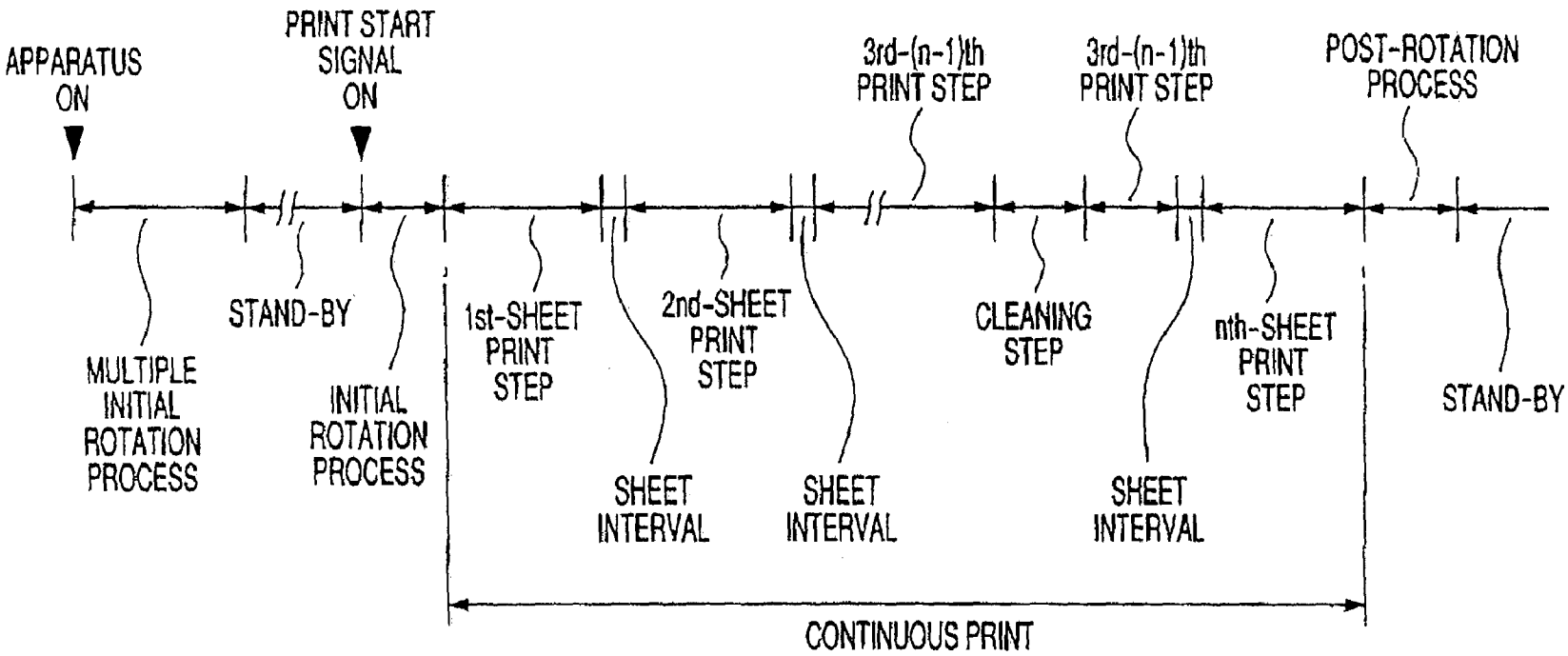
FIG. 8 is a view showing an operation sequence of an image forming apparatus of an embodiment 2.
Figure 9:
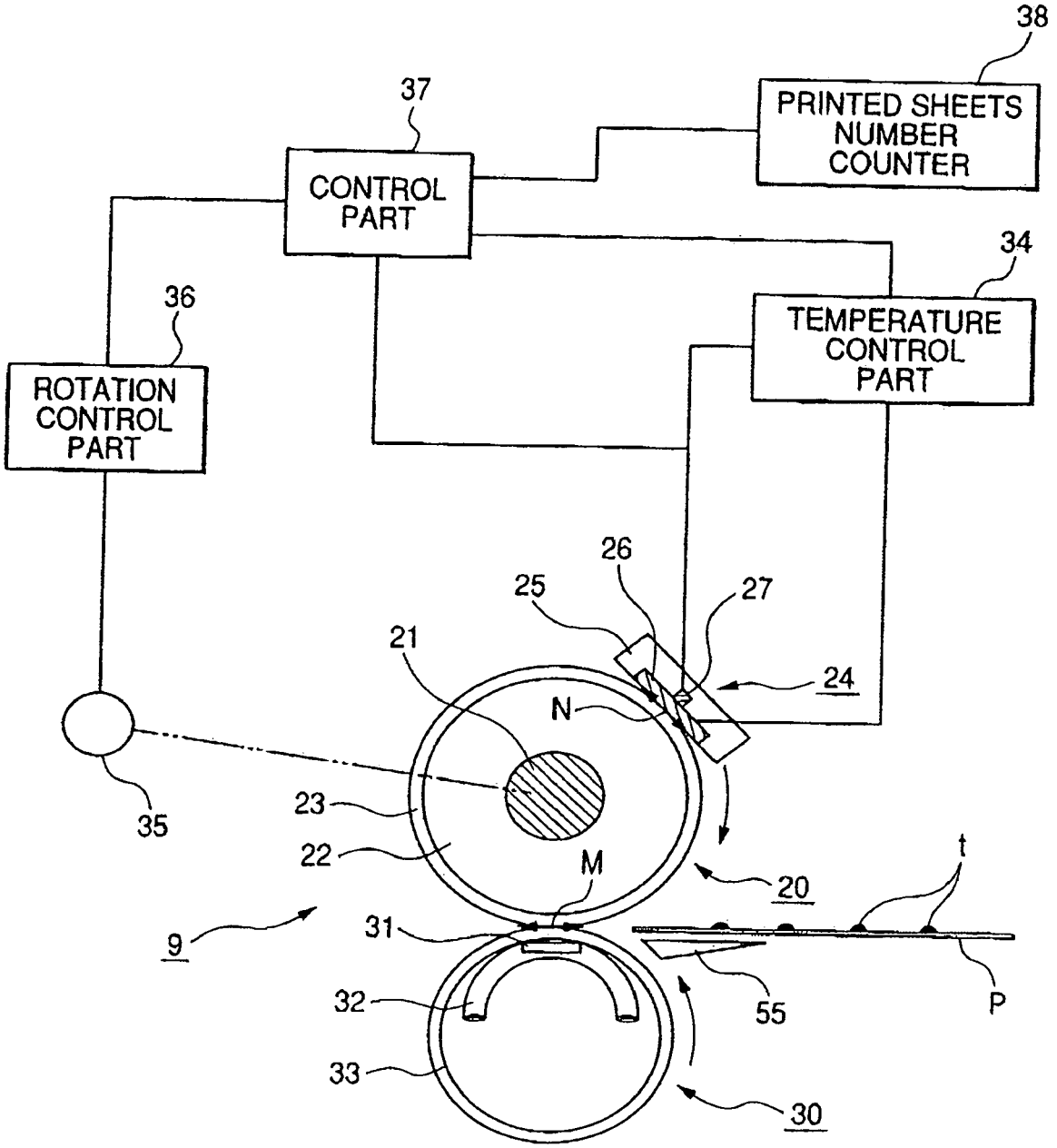
FIG. 9 is a schematic view showing a configuration of a heat fixing apparatus in the embodiment 2.
Figure 10:
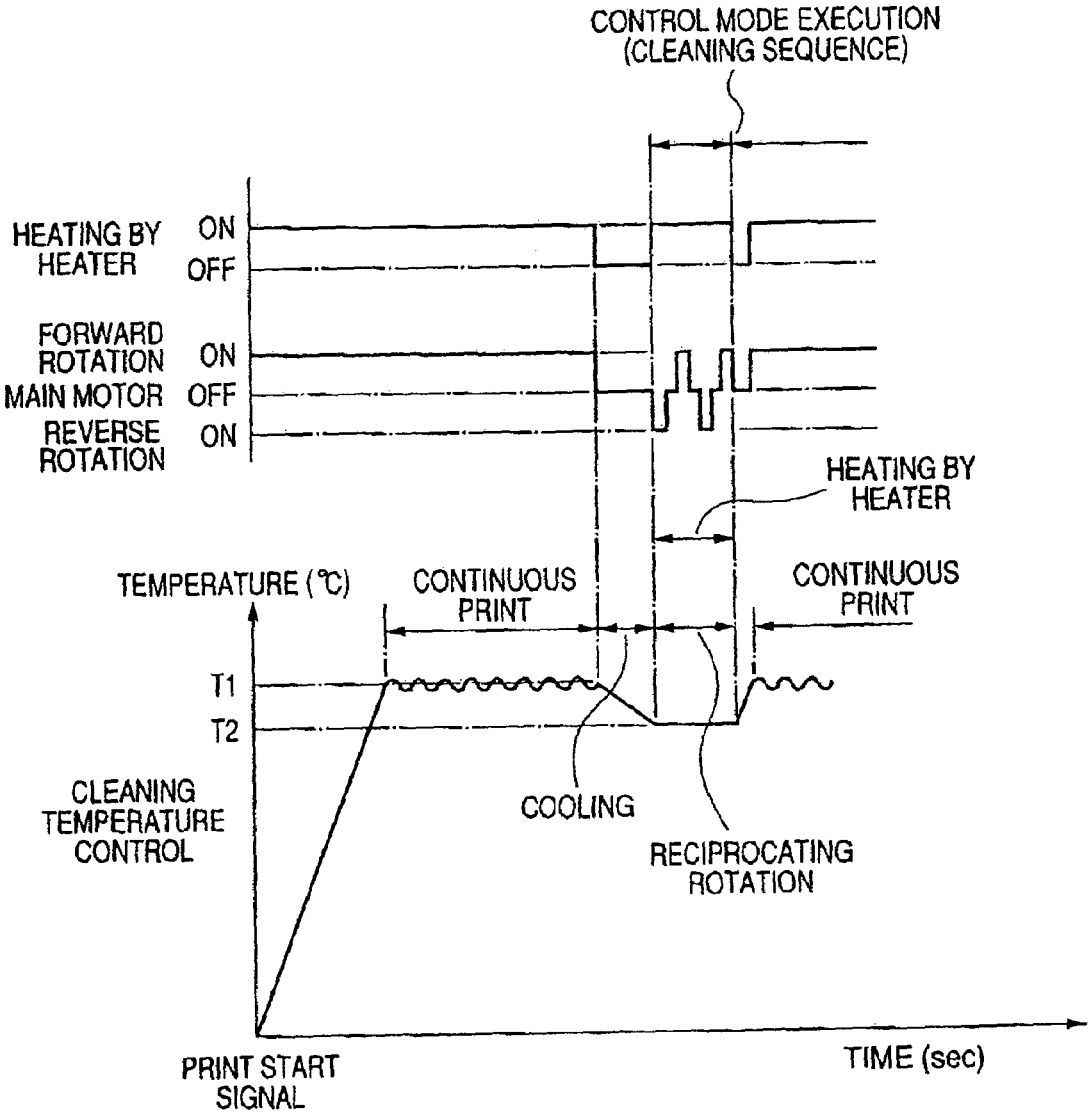
FIG. 10 is a schematic view showing a temperature control of a heater in a control mode, a temperature behavior of the heater, and a rotation control of a fixing roller.
Figure 11:
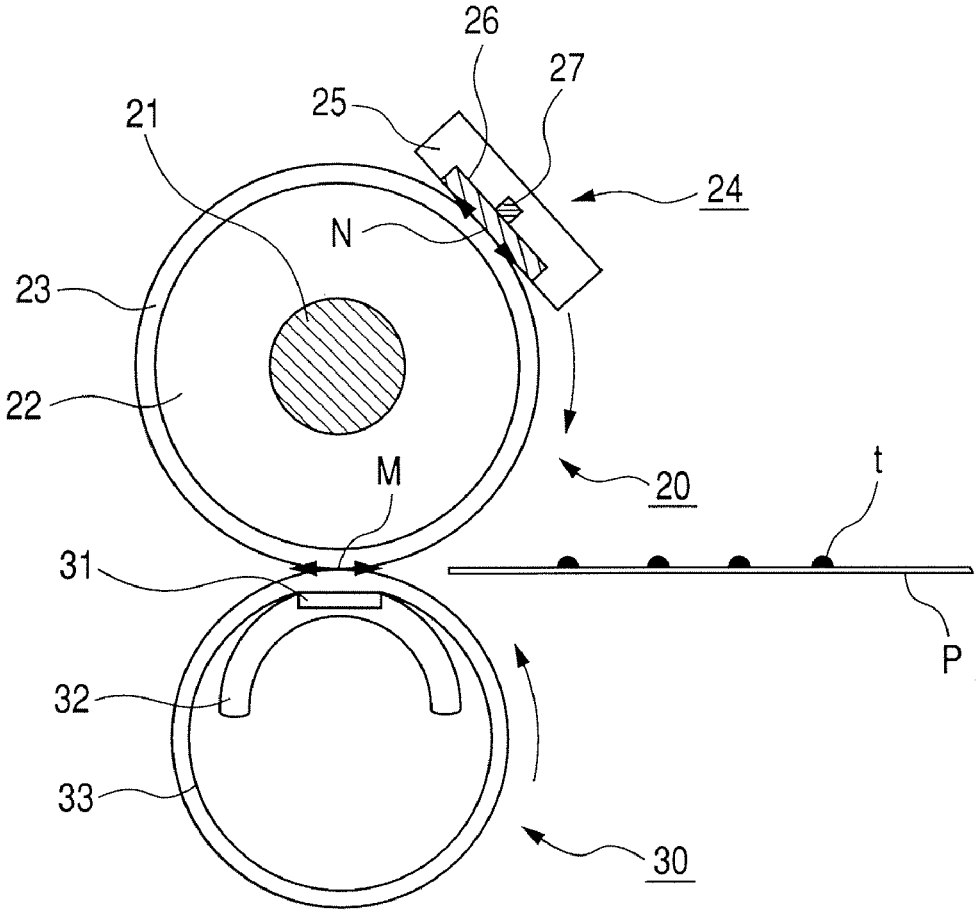
FIG. 11 PRIOR ART
FIG. 11 is a schematic cross-sectional view of a prior heating fixing apparatus.

FIG. 8 is a view showing an operation sequence of the image forming apparatus; FIG. 9 is a schematic view showing the configuration of the heat-fixing apparatus; and FIG. 10 is a schematic view showing a temperature control for the heater 26 in case of executing the control mode, a temperature behavior of the heater 26, and a rotation control of the fixing roller 20.

In the present embodiment, the cleaning sequence is executed during a continuous printing operation. Referring to FIG. 9, a print number counter 38 counts a print number and sends it to a controller 37. The controller 37 accumulates the print number signal received from the print-number counter 38, and, when the cumulative number reaches a predetermined number for executing the cleaning, causes the rotation controller 36 to turn off the main motor 35 and the temperature controller 34 to t urn off the current supply to the heat-generating resistor layer of the heater 26, whereby the heater 26 is cooled.

Then, when the temperature detected by the temperature detector 27 becomes equal to the set heater temperature T2 for the cleaning mode, the controller 37 causes the temperature controller 34 to turn on the current supply to the heat-generating resistor layer of the heater 26, thereby maintaining the temperature T2 capable of fusing the toners t', t" deposited in the heating nit portion N. In this state, each toner is combined. Also, simultaneous with the turning-on of the current supply to the heat-generating resistor layer of the heater 26, the rotation controller 36 turns on and off the main motor 35 alternately clockwise (reverse direction in FIG. 6) and counterclockwise (forward direction in FIG. 6), thereby causing two cycles of reciprocating rotation in the fixing roller 20. In this operation, as explained in the foregoing, the toners t', t" supported on the fixing roller 20 are brought to the fixing nip portion M and are transferred therein onto the surface of the pressure member 30 of a temperature lower than that of the fixing roller 20.

Then the rotation controller 36 turns off the main motor 35 and, at the same time, the temperature controller 34 turns off the current supply to the heat-generating resistor layer of the heater 26, whereby the control mode is terminated.

Upon completion of the control mode, the image forming apparatus restarts the image forming operation.

2) Evaluation

In order to investigate the relationship between the timing for executing the cleaning sequence and the cleaning performance, a continuous sheet-passing durability test was conducted. Continuous sheet passing was conducted with 1,500 sheets per job, and the set control temperature T2 was maintained same as the temperature T1 in the printing operation. Results are shown in Table 2.

TABLE 2

| Timing of cleaning | none | every 500 sheets | every 250 sheets |
|---|---|---|---|
| Image defect | caused after 1,000 sheets | caused after 2,000 sheets | not caused after 20,000 sheets |

In the continuous printing operation, the image defect was caused after 1,000 prints when no cleaning was conducted. In case of executing a cleaning operation for every 500 prints, the image defect was caused after 3,000 prints, but the number of prints prior to the generation of the image defect was made much larger. Also a cleaning operation for every 250 prints could effectively prevent the image defect. Thus, the offset toner, deposited on the heater surface, can be effectively removed by executing the reciprocating rotation of the fixing roller in the course of the continuous printing operation.

1) In the embodiments 1 and 2, there has been explained an example of executing two reciprocating cycles of the fixing roller 20, but such reciprocating rotation of the fixing roller 20 may be executed in one cycle or in three or more cycles.

2) The image heating apparatus of the present invention is applicable, not only to the heat fixing apparatus shown in the embodiments but also to various means or apparatus for heating a recording material bearing an image, such as an image heating apparatus for improving a surface property such as gloss by heating the recording material P bearing an image, or an image heating apparatus for temporary image fixation.

3) For forming an unfixed toner image on the recording material P, there can be employed any image forming process such as an electrophotographic process or an electrostatic recording process of direct type or indirect type.

The present invention is not limited to the aforementioned embodiments but is subject to any and all modifications within the technical concept thereof.

This application claims priority from Japanese Patent Application Nos. 2004-026239 filed Feb. 3, 2004 and 2005-011711 filed Jan. 19, 2005 which are hereby incorporated by reference herein.

What is claimed is:

1. An image heating apparatus for heating a toner image formed on a recording material, comprising:

a rotatable member;

heating means for heating an outer peripheral surface of said rotatable member, said heating means including a heater for forming a heating nip portion in cooperation with said rotatable member;

back-up means for forming a conveying nip portion in cooperation with said rotatable member, the conveying nip portion conveying the recording material; and control means for controlling a temperature of said heater and a rotation of said rotatable member;

wherein said apparatus has a cleaning mode to remove toner from said heating means, and said control means rotates or reversely rotates said rotatable member in a condition that the heater dissipates heat at a temperature equal to or higher than a melting temperature of toner in the cleaning mode, wherein an amount of a rotation or a reverse rotation of said rotatable member in the cleaning mode corresponds to an amount to which a part which forms a heating nip portion in a peripheral direction of said rotatable member moves until the part reaches the conveying nip portion.

2. An image heating apparatus according to claim 1, wherein the cleaning mode is automatically executed after a heating step in which a toner image on recording material is heated.

3. An image heating apparatus according to claim 1, wherein said back-up means comprising:

a sliding member to form the conveying nip portion with said rotatable member; and a flexible sleeve whose internal peripheral surface contacts said sliding member and outer peripheral surface contacts an outer peripheral surface of said rotatable member.

4. An image heating apparatus according to claim 1, wherein said rotatable member includes an elastic layer whose thermal conductivity is equal to or less than 0.15 W/m·k and specific gravity is equal to or less than 0.85.

5. An image heating apparatus according to claim 1, wherein said heater has a ceramic substrate and a heat generating member formed on the ceramic substrate.

* * * * *

UNITED STATES PATENT AND TRADEMARK OFFICE

CERTIFICATE OF CORRECTION

PATENT NO. : 7,155,136 B2
APPLICATION NO. : 11/046872
DATED : December 26, 2006
INVENTOR(S) : Koji Nihonyanagi et al.

It is certified that error appears in the above-identified patent and that said Letters Patent is hereby corrected as shown below:

ON THE TITLE PAGE AT ITEM (57), Abstract:
Line 16, “toner the” should read --the toner--.

COLUMN 1:
Line 44, “rip” should read --nip--.
Line 55, “heating” should read --heat--.

COLUMN 2:
Line 50, “FIG. 2, along a line B—B” should read --FIG. 3, along a line 4—4--.

COLUMN 4:
Line 58, “toner, accumulated” should read --toner is accumulated--.

COLUMN 5:
Line 18, “B—B” should read --4—4--.
Line 21, “cfontact” should read --contact--.

COLUMN 6:
Line 36, “(CTEF)” should read --(CTFE)--.
Line 38, “diamon-like” should read --diamond-like--.

COLUMN 7:
Line 36, “resistance Examples” should read --resistance. Examples--.
Line 37, “is” should read --are--.
Line 47, “sliding film 31” should read --sliding film 33--.

COLUMN 10:
Line 28, “a initial” should read --an initial--.
Line 61, “it:” should read --it--.

COLUMN 12:
Line 5, “print-number” should read --print number--.
Line 9, “t urn” should read --turn--.
Line 18, “nit” should read --nip--.

UNITED STATES PATENT AND TRADEMARK OFFICE

CERTIFICATE OF CORRECTION

PATENT NO. : 7,155,136 B2
APPLICATION NO. : 11/046872
DATED : December 26, 2006
INVENTOR(S) : Koji Nihonyanagi et al.

It is certified that error appears in the above-identified patent and that said Letters Patent is hereby corrected as shown below:

COLUMN 14:
Line 19, "comprising:" should read --comprises:--.

Signed and Sealed this

Eighth Day of May, 2007

JON W. DUDAS
*Director of the United States Patent and Trademark Office*